US006758697B1

(12) United States Patent
Wu

(10) Patent No.: US 6,758,697 B1
(45) Date of Patent: Jul. 6, 2004

(54) ELECTRICAL ADAPTER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/385,794

(22) Filed: Mar. 10, 2003

(51) Int. Cl.[7] ..... H01R 25/00
(52) U.S. Cl. ..... 439/638
(58) Field of Search ..... 439/638, 651, 439/76.1

(56) References Cited

U.S. PATENT DOCUMENTS

D412,700 S 8/1999 Gardner et al.
6,319,066 B2 * 11/2001 Kuo ..... 439/638
6,343,957 B1 * 2/2002 Kuo et al. ..... 439/638
6,379,189 B2 * 4/2002 Sakai et al. ..... 439/651
6,428,330 B1 * 8/2002 Poulter et al. ..... 439/76.1
6,439,916 B1 * 8/2002 Kuo ..... 439/362

* cited by examiner

*Primary Examiner*—Gary Paumen
(74) *Attorney, Agent, or Firm*—Wei Te Chung

(57) ABSTRACT

An electrical adapter (100) includes a first connector (1) including a first housing (10) defining a first and a second mating ports (1040*a* , 1040*b*) respectively with a number of first and second contacts (11, 12) received therein, a second connector (2) back to back assembled to the first housing, a third connector (3) including a third housing (30) back to back assembled to the first housing and a number of third contacts (32) retained in the third housing, and a printed circuit board (4) disposed between the first housing and the third housing. Each first contact includes first engaging portion (110) received in the first housing and an opposite second engaging portion (112) received in the second connector. The second contacts are electrically with the third contacts via the printed circuit board.

3 Claims, 11 Drawing Sheets

ELECTRICAL ADAPTER

CROSS-REFERENCE TO RELATED APPLICATIONS

This patent application is related to U.S. patent application Ser. Nos. 10/211,464 filed on Aug. 1, 2002 and entitled "ELECTRICAL ADAPTER"; 10/269,207 filed on Oct. 11, 2002 and entitled "POWER ADAPTER FOR INTERCONNECTING DIFFERENT TYPES OF POWER CONNECTORS"; 10/271,288 filed on Oct. 15, 2002 and entitled "ADAPTER FOR POWER CONNECTORS"; and 10/278,426 filed on Oct. 22, 2002 and entitled "ELECTRICAL ADAPTER", all of which are invented by the same inventor and assigned to the same assignee as this application.

BACKGROUND OF THE INVENTION

1. Field of the Invention

The present invention relates to an electrical adapter, and particularly to an electrical adapter for joining connectors of different types.

2. Description of Related Art

The design of an electronic device, e.g., a personal computer is repeatedly upgraded with an issuance of each new industrial signal transmission interface standard. Some electrical components such as electrical connectors must accordingly be developed to conform to the new interface standard. Electrical connectors according to different interface standards are generally featured in different configurations and have different numbers of electrical contacts therein. Understandably, such different interface standard connectors cannot mate directly. Many electrical adapters, thereby, are developed to interconnect these different interface standard connectors.

In recent days, an electrical connector known as a Serial Advanced Technology Attachment (Serial ATA) connector according to the newly developed Serial ATA standard is developed to be generally used for connecting storage peripheral devices such as hard disk drives with a mother printed circuit board so as to achieve signal or power transmission therebetween. It should be noted that the Serial ATA power connectors have a larger number of power contacts than other conventional power connectors used in Integrated Drive Electronics (IDE) and are relatively different in configurations. Correspondingly, the present problem people in the art confronts, is that the storage peripheral device using the Serial ATA power connector may be required to connect with the existing mother printed circuit board which originally uses the conventional IDE power connector to connect with the storage peripheral device. Obviously, it is inconvenient and expensive to wholly replace the system, which adds cost.

On the other hand, two separate connectors are generally provided to respectively perform the signal and power transmission between the storage peripheral device and the mother printed circuit board. However, forming the two separate connectors is expensive and inconvenient compared to the formation of a unitary member which can perform the functions of signal and power transmission.

Hence, an electrical adapter electrically interconnecting with connectors of different type so as to perform the functions of signal and power transmission is highly desired.

SUMMARY OF THE INVENTION

Accordingly, an object of the present invention is to provide an electrical adapter for electrically interconnecting connectors of different type so as to perform the functions of signal and power transmission.

In order to achieve the object set forth, an electrical adapter in accordance with the present invention comprises a first connector including a first housing defining a first and a second mating ports and a plurality, of first and second contacts respectively received in the first and second mating ports, a second connector back to back assembled to the first housing, a third connector including a third housing back to back assembled to the first housing and a plurality of third contacts retained in the third housing, and a printed circuit board disposed between the first housing and the third housing. Each first contact includes a first engaging portion received in the first housing and an opposite second engaging portion received in the second connector. The second contacts are electrically with the third contacts via the printed circuit board.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
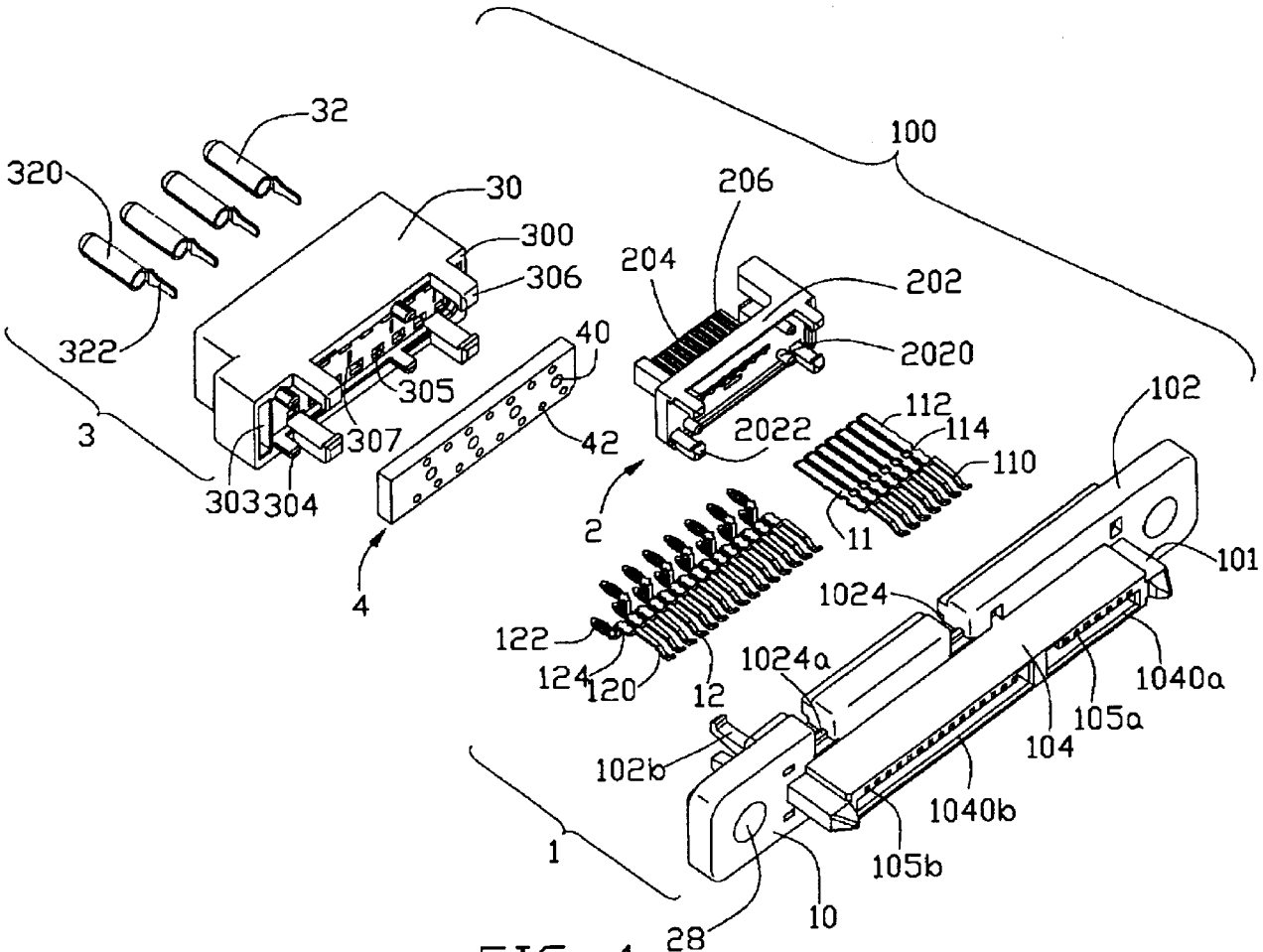
FIG. 1 is an exploded, perspective view of an electrical adapter in accordance with the present invention.
Figure 2:
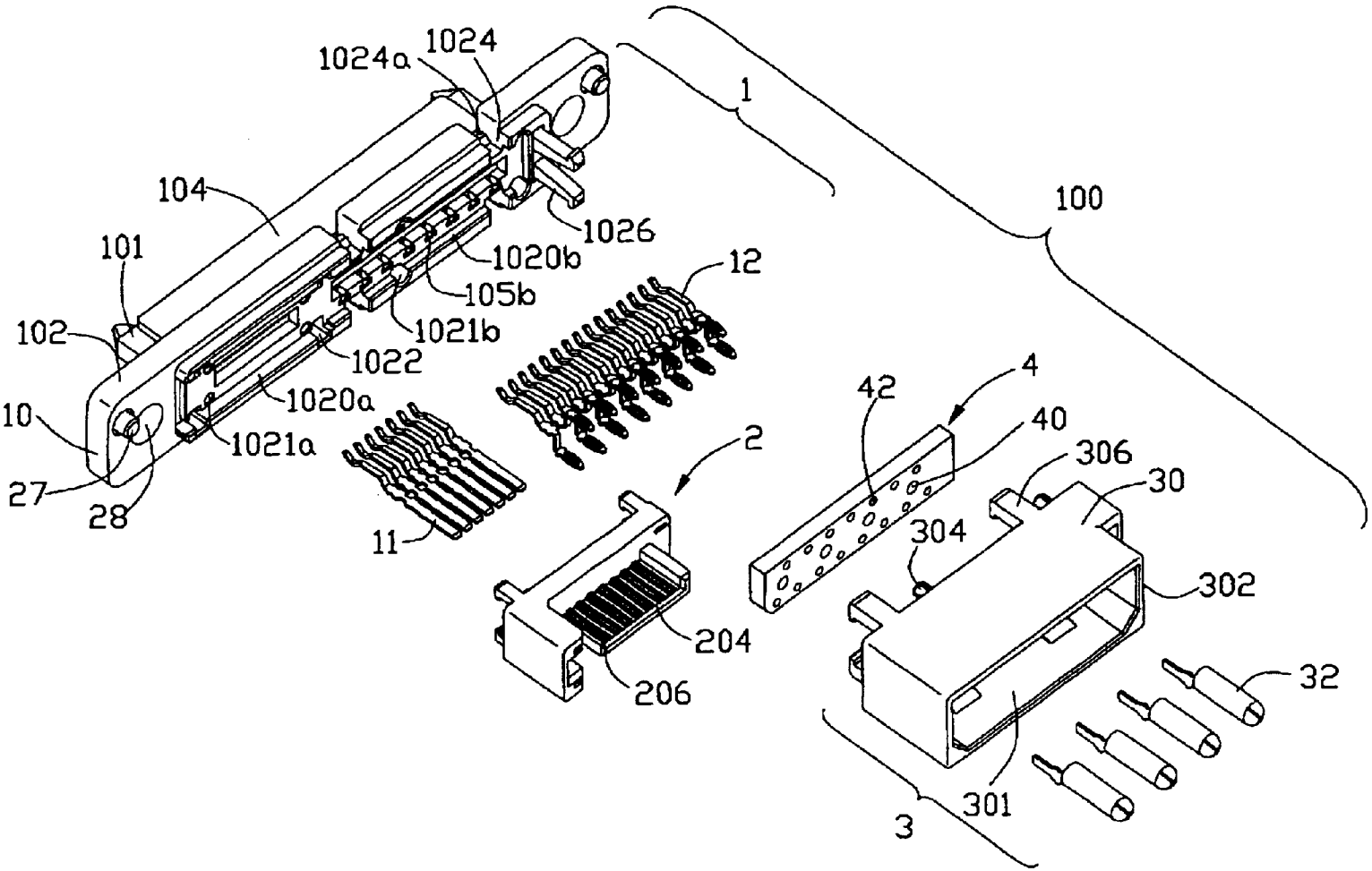
FIG. 2 is a view similar to FIG. 1 but taken from a different perspective.
Figure 3:
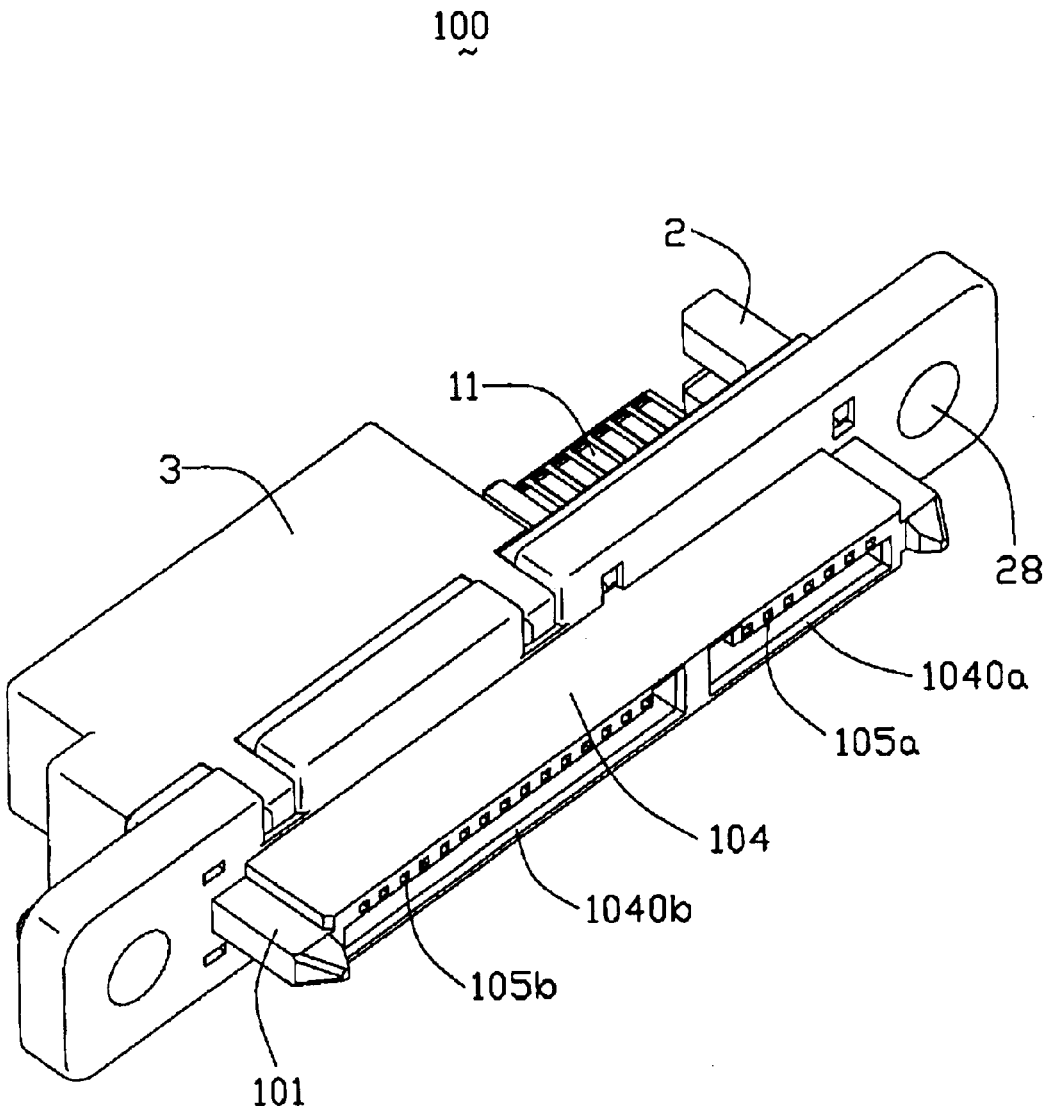
FIG. 3 is an assembled, perspective view of the electrical adapter shown in FIG. 1.
Figure 4:
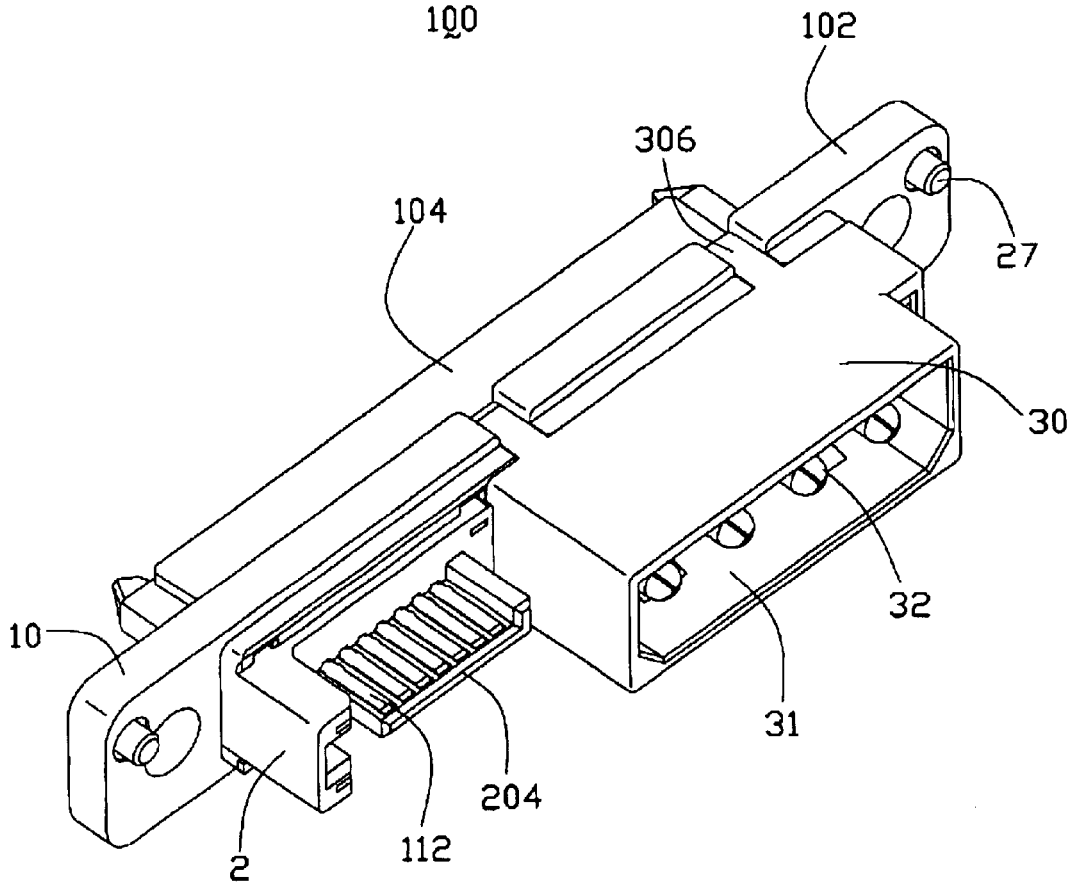
FIG. 4 is an assembled, perspective view of the electrical adapter shown FIG. 2.

Referring to FIGS. 1 and 2, an electrical adapter 100 mounted on a panel 200 (shown in FIG. 5) in a computer system in accordance with, the present invention comprises a first connector 1, a second connector 2 and a third connector 3 respectively back to back assembled to the first connector 1, and a transition printed circuit board 4 located between the first connector 1 and the third connector 3. In the preferred embodiment, the first connector 1 is a Serial Advanced Technology Attachment (Serial ATA) receptacle connector. The second connector 2 is a Serial ATA plug connector. The third connector 3 is a conventional Integrated Drive Electronics (IDE) power plug connector.

The first connector 1 comprises a first insulating housing 10 and a plurality of signal and power contacts 11, 12 retained in the housing 10. The housing 10 has an elongate base 102 and a mating section 104 perpendicularly extending forwardly from the base 102. A pair of guiding posts 101 is disposed adjacent to opposite ends of the mating section 104 for guiding the first connector 1 to mate with a first complementary connector (not shown).

Figure 8:
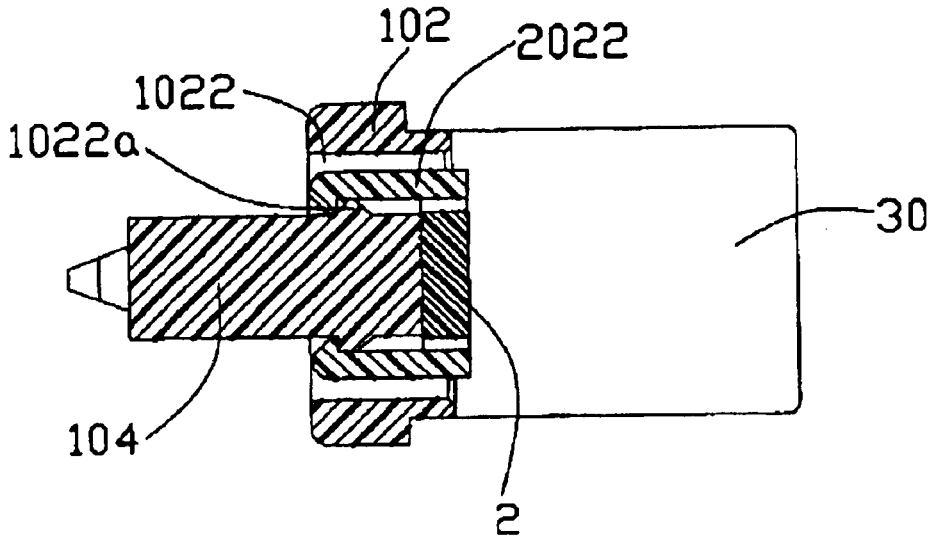
FIG. 8 is a cross-sectional view taken along section line 8—8 of FIG. 6.
Figure 9:
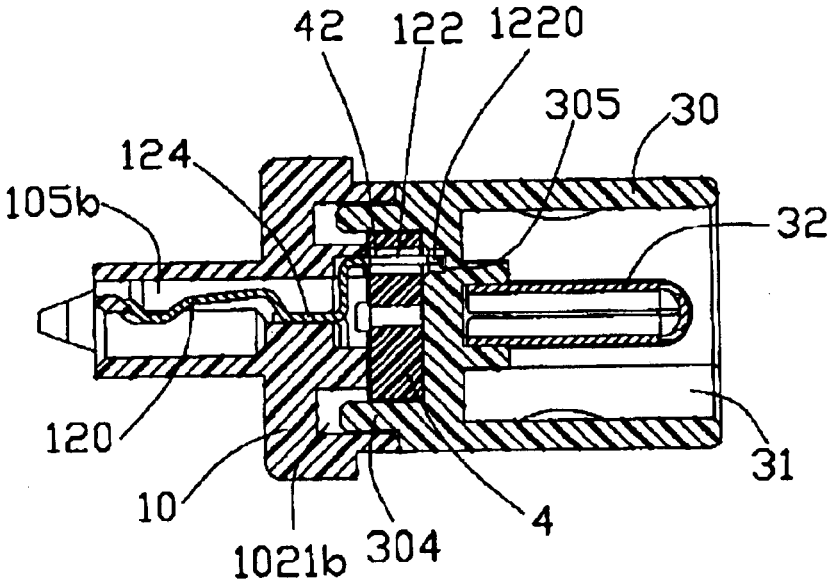
FIG. 9 is a cross-sectional view taken along section line 9—9 of FIG. 6.
Figure 10:
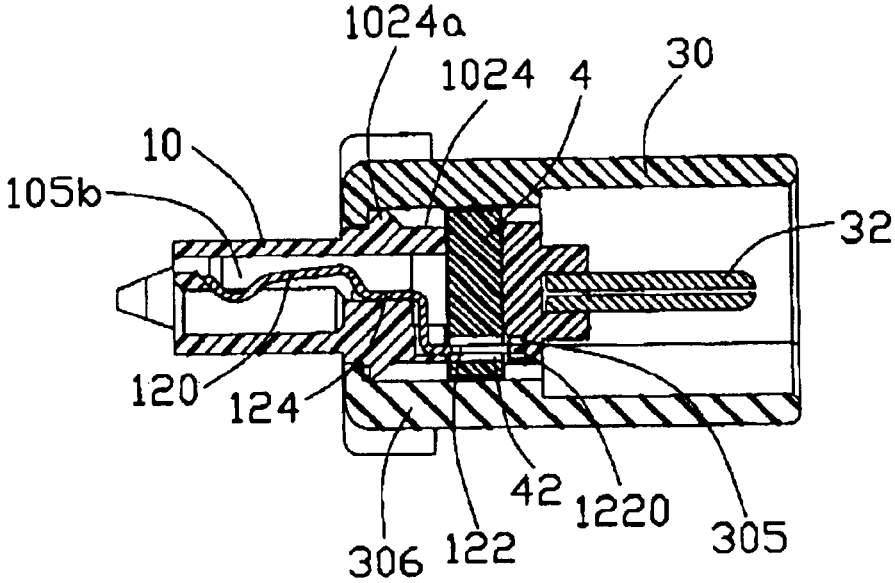
FIG. 10 is a cross-sectional view taken along section line 10—10 of FIG. 6.
Figure 11:
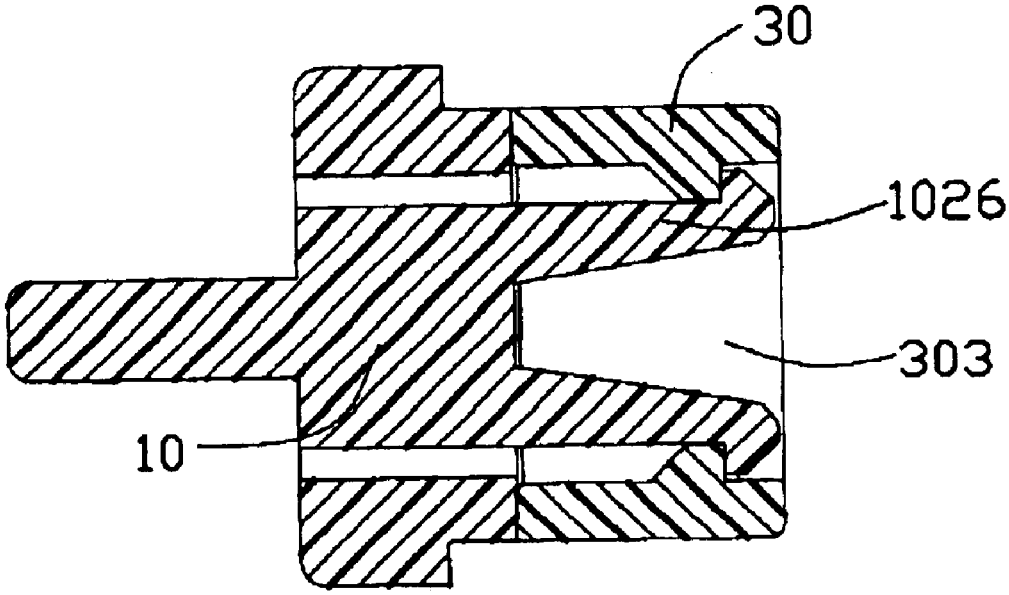
FIG. 11 is a cross-sectional view taken along section line 11—11 of FIG. 6.
Figure 12:
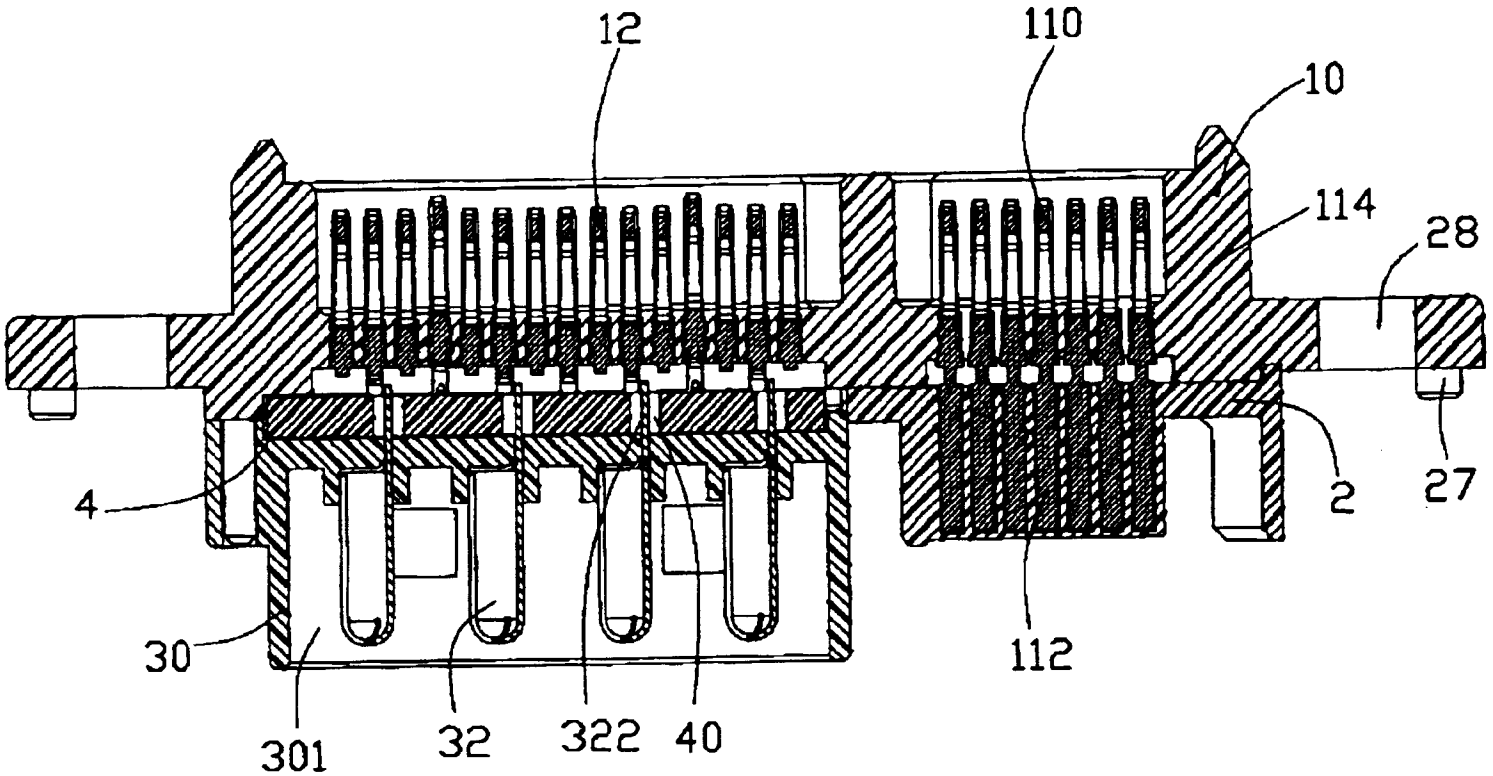
FIG. 12 is a cross-sectional view taken along section line 12—12 of FIG. 6.
Figure 13:
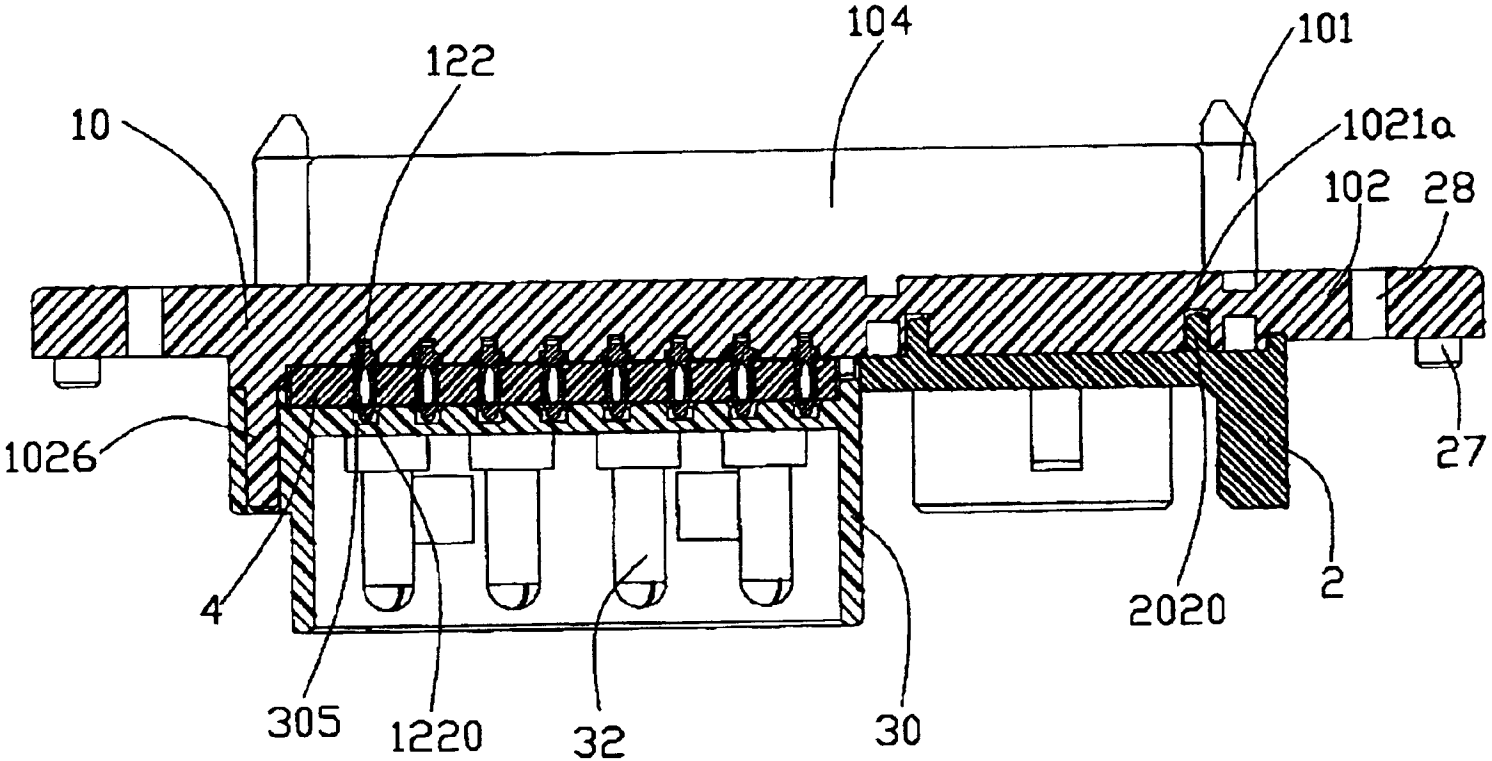
FIG. 13 is a cross-sectional view taken along section line 13—13 of FIG. 6.

The mating section 104 includes a first and a second mating ports 1040*a*, 1040*b* arranged in a side-by-side manner wherein the first mating port 1040*a* has a lengthwise dimension smaller than the second mating port 1040*b*. The base 102 defines a first and a second cavities 1020*a*, 1020*b* in a rear side thereof respectively communicating with the first and second mating ports 1040*a*, 1040*b*, and a plurality of first and second holes 1021*a*, 1021*b*respectively communicating with the first and second cavities 1020*a*, 1020*b*. A plurality of slots 1022 is defined in the base 102 adjacent to the corresponding first holes 1021*a* communicating with the first cavity 1020*a* each with a projection 1022*a* (shown in FIG. 8) formed therein. A plurality of notches 1024 is defined on opposite top and bottom surfaces of the base 102 adjacent to the corresponding second holes 1021*b* each with a projection 1024*a* formed therein. A pair of first locking members 1026 is formed on the base 102 adjacent to the second cavity 1020*b*. The base 102 further forms a pair of first positioning posts 27 and first positioning holes 28 at opposite ends thereof.

The first housing 10 defines a plurality of first and second passageways 105*a*, 105*b* respectively extending from the first and second mating ports 1040*a*, 1040*b*. The signal and power contacts 11, 12 are respectively received in the first and second passageways 105*a*, 105*b* of the first housing 10. Each signal contact 11 includes a first engaging portion 110 received in the first mating port 1040*a*, a second opposite engaging portion 112 rearwardly extending out of the base 102 and an intermediate portion 114 interconnecting the first engaging portion 110 with the second engaging portion 112. The power contact 12 includes a contact portion 120 received in the second mating port 1040*b*, a press-fit portion 122 arranged in two rows in a staggered manner and an intermediate portion 124 interconnecting the contact portion 120 and the press-fit portion 122.

The second connector 2 comprises an L-shaped base 202 and a mating tongue 204 extending perpendicularly from the base 202. The base 202 forms a plurality of second positioning posts 2020 and second locking members 2022 corresponding to the first holes 1021 a and the slots 1022 of the first housing 10 for engagement therewith. The second connector 2 defines a plurality of passageways 206 extending from the mating tongue 204 through the base 202 with the second engaging portions 112 of the signal contacts 11 received therein.

The third connector 3 comprises a third insulating housing :30 and four power pins 32 retained in the third insulating housing 30. The third housing 30 has a front surface 300 and an opposite rear surface 302. The third housing 30 defines a receiving cavity 301 in the rear surface 302, a receiving slot 303 in the front surface 300 adjacent to one end thereof for fittedly receiving the first locking members 1026, a plurality of cutouts 305 in the front surface 300 arranged in a pattern conforming to the arrangement of the press-fit portions 122 of the power contacts 12 and four slits 307 in the front surface 300 communicating with the receiving cavity 301. A plurality of third positioning posts 304 and third locking members 306 extend forwardly from the front surface 300 of the third housing 30 for respectively engaging the second holes 1021*b* and the notches 1024 of the first housing 10.

Each power pins 32 includes an engaging portion 320 received in the receiving cavity 301 for engagement with a third complementary connector (not shown) and a solder tail 322 extending forwardly from the engaging portion 320. The solder tails 322 of the power pins 32 extend beyond the front surface 300 of the third housing 30 through the four slits 307.

The transition printed circuit board 4 defines four first through holes 40 and a plurality of second through holes 42 penetrating through opposite surfaces thereof for receiving the solder tails 322 of the power pins 32 and the press-fit portions 122 of the power contacts 12, respectively. A plurality of electrical traces (not shown) are arranged on the printed circuit board 4 to thereby conductively connecting the four power pins 32 of the third connector 3 with the predetermined power contacts 12 of the first connector 1 via corresponding first and second through holes 40, 42.

Referring to FIGS. 3–4 and 6–13 in conjunction with FIGS. 1–2, in assembly, the second connector 2 is assembled to the first connector along a back-to-front direction. The second positioning posts 2020 are received in the first holes 1021*a* and the second locking members 2022 are latched with corresponding projections 1022*a* in the slots 1022 to thereby interlocking the first connector 1 and the second connector 2 together. The second engaging portion 112 of the signal contacts 11 extend out of the first housing 10 through the first cavity 1020*a* to be received in the passageways 206 of the second connector 2 for engagement with a second complementary connector (not shown).

The printed circuit board 4 is attached to a front side of the third connector 3 whereby the solder tails 322 of the power pins 32 are received in the first through holes 40 of the printed circuit board 4 and are soldered on one side of the printed circuit board 4 to form an electrical subassembly. The subassembly is then assembled to the rear side of the first housing 10 with the printed circuit board 4 partially received in the second cavity 1020*b*. The press-fit portions, 122 of the power contacts 12 are press-fitted in the second through holes 42 of the printed circuit board 4 with terminating ends 1220 (shown in FIG. 9) thereof received in the cutouts 305 of the third housing 30. The third positioning posts 304 are received in the second holes 1021*b* of the first housing 10 and the third locking members 306 are latched with corresponding projections 1024*a* in the notches 1024 of the first housing 10, whereby the first connector 1 and the third connector 3 arc interlocked with each other having the printed circuit board 4 disposed therebetween. The electrical adapter 100 is thus formed.

Figure 5:
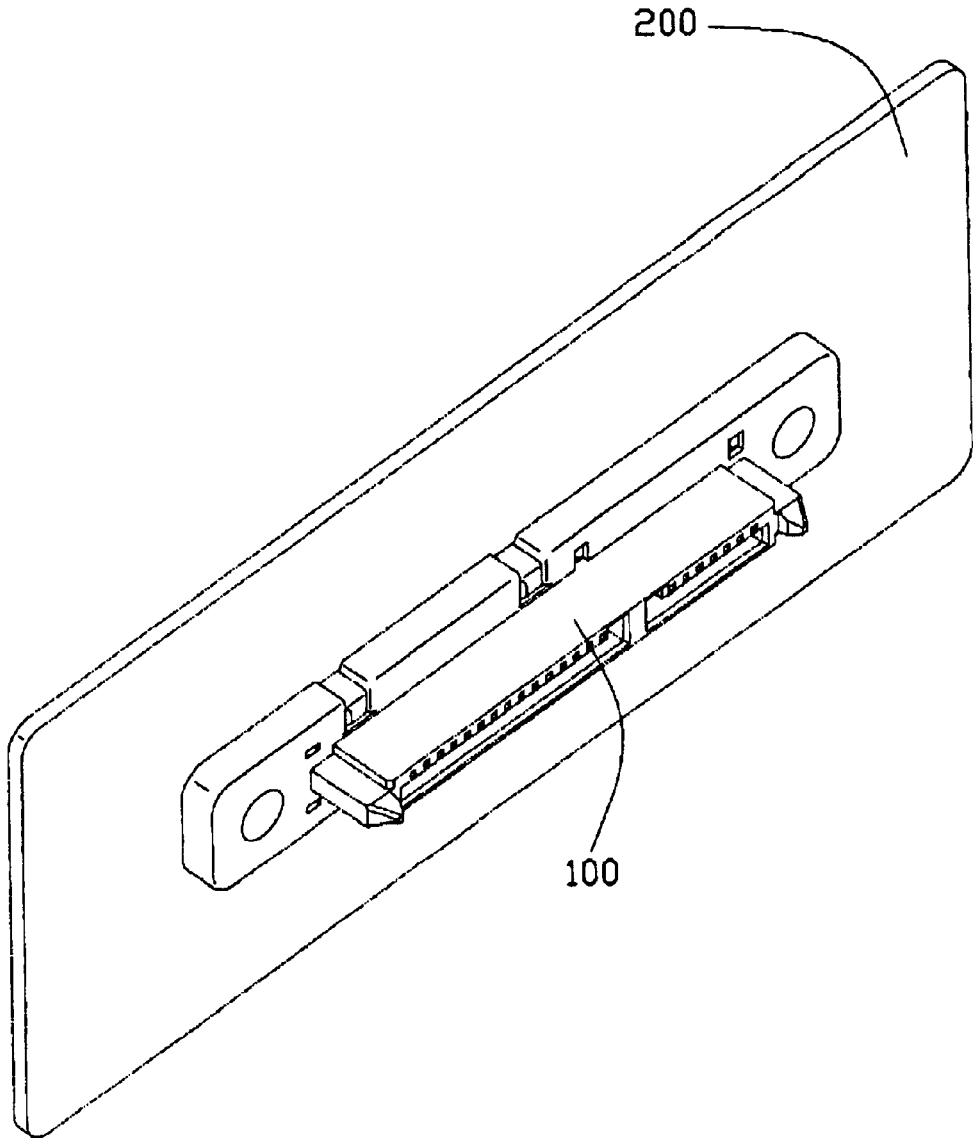
FIG. 5 is a perspective view showing the electrical adapter of FIG. 3 mounted on a panel.
Figure 6:
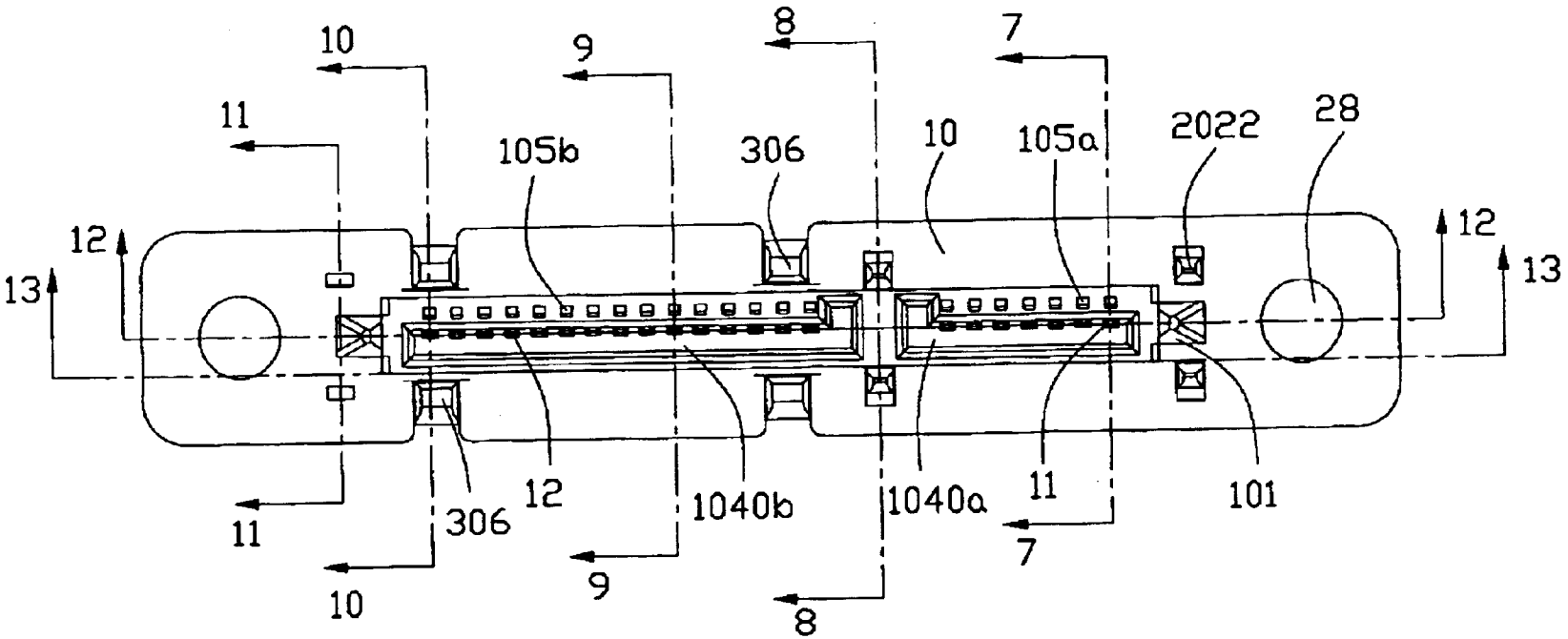
FIG. 6 is a front, plane view of the electrical adapter of FIG. 3.
Figure 7:
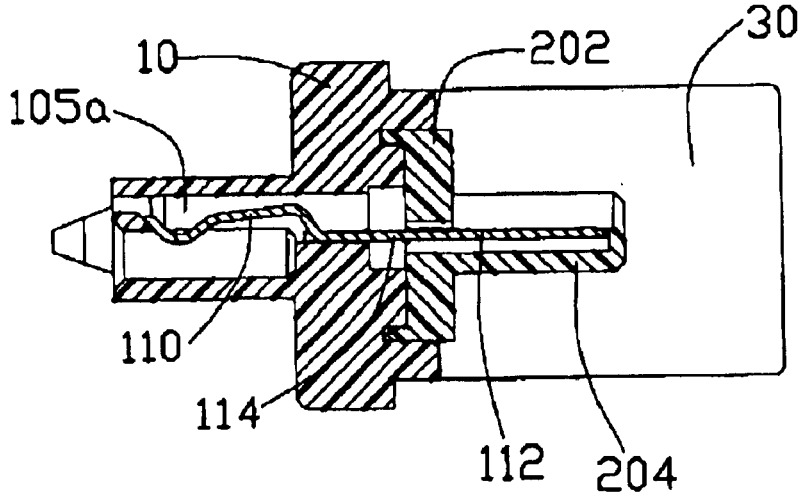
FIG. 7 is a cross-sectional view taken along section line 7—7 of FIG. 6.

FIG. 5 shows the electrical adapter 100 mounted on the panel 200 in a computer system (not shown) with the pair of first positioning posts 27 received in corresponding positioning holes (not shown) defined in the panel 200. The panel 200 defines a pair of positioning holes (not shown) corresponding to the pair of first positioning holes 28 of the first housing 2 to allow a fastening element (not shown) extending therethrough whereby the electrical adapter 100 is stably mounted on the panel 200. The first connector 1 is disposed on one side of the panel 200 while the second and third connectors 2, 3 are disposed on an opposite side of the panel 200. It is noted that when the electrical adapter 100 is mounted on the panel 200, the third locking members 306 of the third connector 3 can not disengage from the corresponding projections 1024*a* in the notches 1024 of the first connector 1 whereby the first connector 1 and the third connector 3 are reliably interlocked with each other.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter comprising:

a first connector configured with a Serial Advanced Technology Attachment (Serial ATA) interface and comprising a first and a second mating ports;

a second connector configured with a Serial ATA interface thereof and connected to the first mating port of the first connector for providing signal transmission therebetween; and a third connector configured as a conventional power connector and electrically connected to the second mating port of the first connector for providing power transmission therebetween;

wherein the first and second mating ports are arranged in a side-by-side manner;

wherein the first mating port has a smaller dimension than the second mating port in a lengthwise direction thereof;

wherein the first connector is a Serial ATA receptacle connector, the second connector is a Serial ATA plug connector and the third connector is a conventional power plug connector;

wherein the electrical adapter comprises a printed circuit board disposed between the first connector and the third connector.

2. An electrical adapter comprising:

a first connector comprising a first insulating housing and a plurality of first and second contacts retained to the first housing, each first contact comprising a first engaging portion received in the first housing and an opposite second engaging portion;

a second connector back to back assembled to the first housing and receiving the second engaging portions of the first contacts therein; and a third connector comprising a third insulating housing back to back assembled to the first housing and a plurality of third contacts different from and electrically connected with the second contacts of the first connector;

wherein the first connector is configured with a Serial Advanced Technology Attachment (Serial ATA) interface;

wherein the first housing defines first and second mating ports, and the first and second contacts are respectively received in the first and second mating ports;

wherein the first and second mating ports of the first connector are arranged in a side-by-side manner;

wherein the first contacts are signal contacts and the second contacts are power contacts;

wherein said second contacts and said third contacts are electrically connected via a printed circuit board sandwiched between said first and third connectors;

wherein said first connector includes, along a lengthwise direction thereof, an elongated base which the first and second mating ports integrally extend from on one side thereof, and the juxtaposed second and third connectors are, on the other side thereof, attached to, respectively, along said lengthwise direction.

3. An electrical adapter comprising:

a first connector comprising a first housing defining a first and a second mating ports respectively receiving a plurality of first and second contacts therein, each second contact comprising a press-fit portion;

a second connector back to back assembled to the first housing;

a third connector comprising a third housing back to back assembled to the first housing and a plurality of third contacts retained in the third housing; and a printed circuit board disposed between the first and third housings with the third contacts soldered thereto and the press-fit portions of the second contacts press-fitted into thereto;

wherein each first contact comprises a first engaging portion received in the first housing for electrical connection with a first complementary connector, and an opposite second engaging portion received in the second connector for electrical connection with a second complementary connector;

wherein the second contacts and the third contacts have different numbers and different positions relative to each other;

wherein the first connector and the second connector define locking and positioning members for back-to-back assembling the first connector and the second connector together;

wherein the first connector and the third connector define locking and positioning members for back-to-back assembling the first connector and the third connector together;

wherein the third housing defines a plurality of cutouts, and the press-fit portion of the second contacts have terminating ends received in the corresponding cutouts.

* * * * *